US008757607B1

(12) United States Patent
Benaksas et al.

(10) Patent No.: US 8,757,607 B1
(45) Date of Patent: Jun. 24, 2014

(54) FOOD SLICER

(71) Applicants: Abraham Benaksas, Hollywood, FL (US); Bonnie-Jo Rudner, Hollywood, FL (US)

(72) Inventors: Abraham Benaksas, Hollywood, FL (US); Bonnie-Jo Rudner, Hollywood, FL (US)

( * ) Notice: Subject to any disclaimer, the term of this patent is extended or adjusted under 35 U.S.C. 154(b) by 0 days.

(21) Appl. No.: 13/911,901

(22) Filed: Jun. 6, 2013

Related U.S. Application Data

(60) Provisional application No. 61/701,202, filed on Sep. 14, 2012.

(51) Int. Cl.

| | |
|---|---|
| ***B26D 7/22*** | (2006.01) |
| ***B26D 5/00*** | (2006.01) |
| ***B23Q 3/00*** | (2006.01) |
| ***B26B 29/06*** | (2006.01) |

(52) U.S. Cl.
CPC ..... *B26B 29/063* (2013.01)
USPC ..... 269/289 R; 83/821; 83/761

(58) Field of Classification Search
CPC ..... B26D 5/00; B26D 7/00; B23Q 3/00
USPC ..... 269/289 R, 309, 287, 288, 290, 291; 83/397, 761, 745, 762, 454, 465, 870, 83/932, 451
See application file for complete search history.

(56) References Cited

U.S. PATENT DOCUMENTS

| | | | | |
|---|---|---|---|---|
| 2,816,588 | A | 12/1957 | Miron | |
| 4,059,870 | A * | 11/1977 | Finkelman | 452/17 |
| 4,550,636 | A | 11/1985 | Josselson et al. | |
| 4,807,862 | A | 2/1989 | Popeil et al. | |
| 4,948,106 | A | 8/1990 | Popeil et al. | |
| 5,366,208 | A * | 11/1994 | Benjamin | 269/289 R |
| 5,626,067 | A * | 5/1997 | Lothe | 269/289 R |
| 5,819,629 | A | 10/1998 | Sarich | |
| 5,924,352 | A * | 7/1999 | Lothe | 269/309 |
| 5,927,701 | A | 7/1999 | Chapman | |
| 6,128,996 | A | 10/2000 | Sato et al. | |
| 6,805,031 | B1 | 10/2004 | Stallato | |
| 7,216,574 | B2 | 5/2007 | Woods | |
| 2002/0151266 | A1 | 10/2002 | Kidushim et al. | |
| 2012/0031250 | A1 * | 2/2012 | Hocker | 83/821 |

* cited by examiner

*Primary Examiner* — Lee D Wilson
*Assistant Examiner* — Seahee Yoon
(74) *Attorney, Agent, or Firm* — Gold & Rizvi, P.A.; Glenn E. Gold

(57) ABSTRACT

A food slicer a base having a peripheral wall with a top rim and defining a central void. A plurality of support surfaces extends into the central void from an interior of the base below the rim wherein the support surfaces are substantially co-planar. A cover is selectively movable between an open and closed position. A cutting plate is dimensioned to fit within the central void and engages the support surfaces. The cutting plate is selectively invertible between a thin cutting position and a thick cutting position wherein the thin cutting position has a first cutting surface more proximate to the rim than a second cutting surface when the cutting plate is inverted from the thin cutting position.

19 Claims, 14 Drawing Sheets

FOOD SLICER

CROSS-REFERENCE TO RELATED APPLICATION

This Non-Provisional Utility application claims the benefit of U.S. Provisional Patent Application Ser. No. 61/701,202, filed on Sep. 14, 2012, which is incorporated herein in its entirety.

FIELD OF THE INVENTION

The invention relates to devices for slicing food products. More particularly, the invention is a food slicing apparatus for quickly and safely slicing thick cuts of food products into thinner slices.

BACKGROUND OF THE INVENTION

Commercial and residential kitchens are tasked with properly preparing numerous types of food products such as chicken, other poultry, fish, meat, breads, cheeses, fruits, vegetables, and many other products. A common problem during food preparation is that food products are inconveniently sized. This problem has motivated the development of a large number of devices for cutting, chopping, grating, slicing, dicing, blending, pureeing, crushing, peeling and generally shaping food products into their desired dimensions. The range of available food preparation devices in cost, size, and complexity is a tribute to ingenuity.

Despite the numerous food preparation devices that have been developed, it does not imply that all food preparation problems have been solved. It is well known that there are a number of food products, particularly chicken and other poultry, which often have undesired dimensions for preparation. For example, available chicken cutlets are often too thick for an intended dish or serving. Cutting a thick chicken cutlet into thinner chicken cuts is not trivial. A sharp blade is required to slice the chicken, which makes such slicing dangerous. In addition, to accurately cut a thin cutlet from a thicker cutlet requires proper positioning and accurate control of both the knife and the cutlet. Compounding the problem is that chicken, other poultry and fish cutlets are usually moist and slippery and should be firmly held in a manner that enables accurate cutting.

In the prior art are devices suitable for slicing products such as chicken, other poultry, meats, and fish. Some are relatively large and expensive and are better suited to large scale slicing operations rather than point of preparation slicing. Others are general slicers that are far from optimized for cutting chicken, poultry, meats, and fish. Still others are rather complex, heavy, or large and thus unsuited for low cost, point of preparation slicing tasks. Such limits their usefulness for some applications.

In view of the foregoing, there remains a need for a flexible, easy to use food slicing apparatus for accurately slicing thicker cuts of food products such as chicken, other poultry, meats, and fish into thinner cuts. Beneficially, such an apparatus would be safe and easy to use. Preferably, such an apparatus would also be suitable for low cost implementations. Even more preferably, the food slicing apparatus would be able to accurately cut more than one cutlet thickness.

SUMMARY OF THE INVENTION

The present invention provides for a flexible, easy to use apparatus for slicing thicker cuts of food products such as chicken, other poultry, meats, and fish into thinner cuts. The present invention is suitable for easy, safe operation, is highly flexible, and is suitable for low cost implementation.

A food slicer in accord with the present invention includes a base having a peripheral wall with a top rim and defining a central void. A plurality of support surfaces extends into the central void from an interior of the base below the rim wherein the support surfaces are substantially co-planar. A cover is selectively movable between an open and closed position. A cutting plate is dimensioned to fit within the central void and engages the support surfaces. The cutting plate is selectively invertible between a thin cutting position and a thick cutting position wherein the thin cutting position has a first cutting surface more proximate to the rim than a second cutting surface when the cutting plate is inverted from the thin cutting position.

In another aspect, the base is rectangular in shape.

In still another aspect, a support surface is positioned at each of an interior corner of said rectangular base.

In yet another aspect, the cover is formed of a flexible material.

In yet aspect, the edge of the cover opposite from the end affixed to the base is formed as an obtuse angle.

In yet another aspect, at least one surface of the cover has a friction-enhanced surface.

In yet another aspect, the cutting plate includes a body defining a first cutting surface on a first side and a second cutting surface on an opposite side thereof. The cutting plate includes a first bearing surface opposite from the first side for contacting the support surfaces and for presenting the first cutting surface for use and when the cutting plate is inverted, the cutting plate includes a second bearing surface opposite from the second side for contacting the support surfaces and for presenting the second cutting surface for use.

In yet another aspect, the body defines a plurality of holes therethrough.

In yet another aspect, the first cutting surface and the second cutting surface are configured as a friction enhanced surface.

In yet another aspect, the cutting plate includes a peripheral lip extending upwardly from the second cutting surface, an uppermost edge of the peripheral lip defines the first bearing surface for engaging the support surfaces of the base when the cutting plate is oriented to present the first cutting surface for use.

In yet another aspect, the cutting plate includes a plurality of "L" shaped recesses in the thin slicing surface of the body. The "L" shaped recesses define the second bearing surface for engaging the support surfaces of the base when the cutting plate is oriented to present the second cutting surface for use.

In yet another aspect a food slicer includes a base having two sides, a front wall disposed between the fronts of the sides, and a rear wall disposed between the rears of the sides wherein the tops of the sides and the walls define a rim. The base further includes an interior post at each corner wherein each interior post has an upper surface. A pivoting protective cover is attached to the rear wall and dimensioned to span across the rim. A cutting plate is dimensioned to fit within the base so as to rest on the upper surfaces. The cutting plate is selectively invertible between a first orientation for presenting a first cutting surface for use and a second orientation for presenting a second cutting surface for use.

In yet another aspect, the cutting plate has a plate body with "L" shaped steps on one side thereof and the second cutting surface is opposed from the "L" shaped steps. The first cutting surface is adjacent the "L" shaped steps. The "L" shaped steps are located and dimensioned to rest on the upper surfaces so as to form a first distance between the second cutting surface and the rim and when the second cutting surface rests on the upper surfaces a second distance is formed between the first cutting surface and the rim wherein the second distance is less that the first distance.

In yet another aspect, the second cutting surface and said first cutting surface are formed as a friction-enhancing surface.

In yet another aspect, the cutting plate has a plate body defining the first cutting surface on a first side thereof and the second cutting surface on a second side thereof and includes a lip extending upwardly from a periphery of the second cutting surface. When the first cutting surface rests on the upper surfaces a first distance is formed between the second cutting surface and the rim and when the cutting plate is inverted an upper edge of the lip rests on the upper surfaces to form a second distance between the first cutting surface and the rim wherein the second distance is less than the first distance.

In yet another aspect, the plate body defines a plurality of holes therethrough.

In yet another aspect, the protective cover is formed of a flexible material.

In yet another aspect, at least one surface of said cover has a friction-enhanced surface.

In yet another aspect, an edge of the cover opposite from the end affixed to the base is formed as an obtuse angle.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings that are provided to illustrate the principles of the present invention but not to limit the invention, in which.

Like reference numerals refer to like parts throughout the several views of the drawings.

DETAILED DESCRIPTION

The following detailed description is exemplary only and is not intended to limit the invention or its application. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
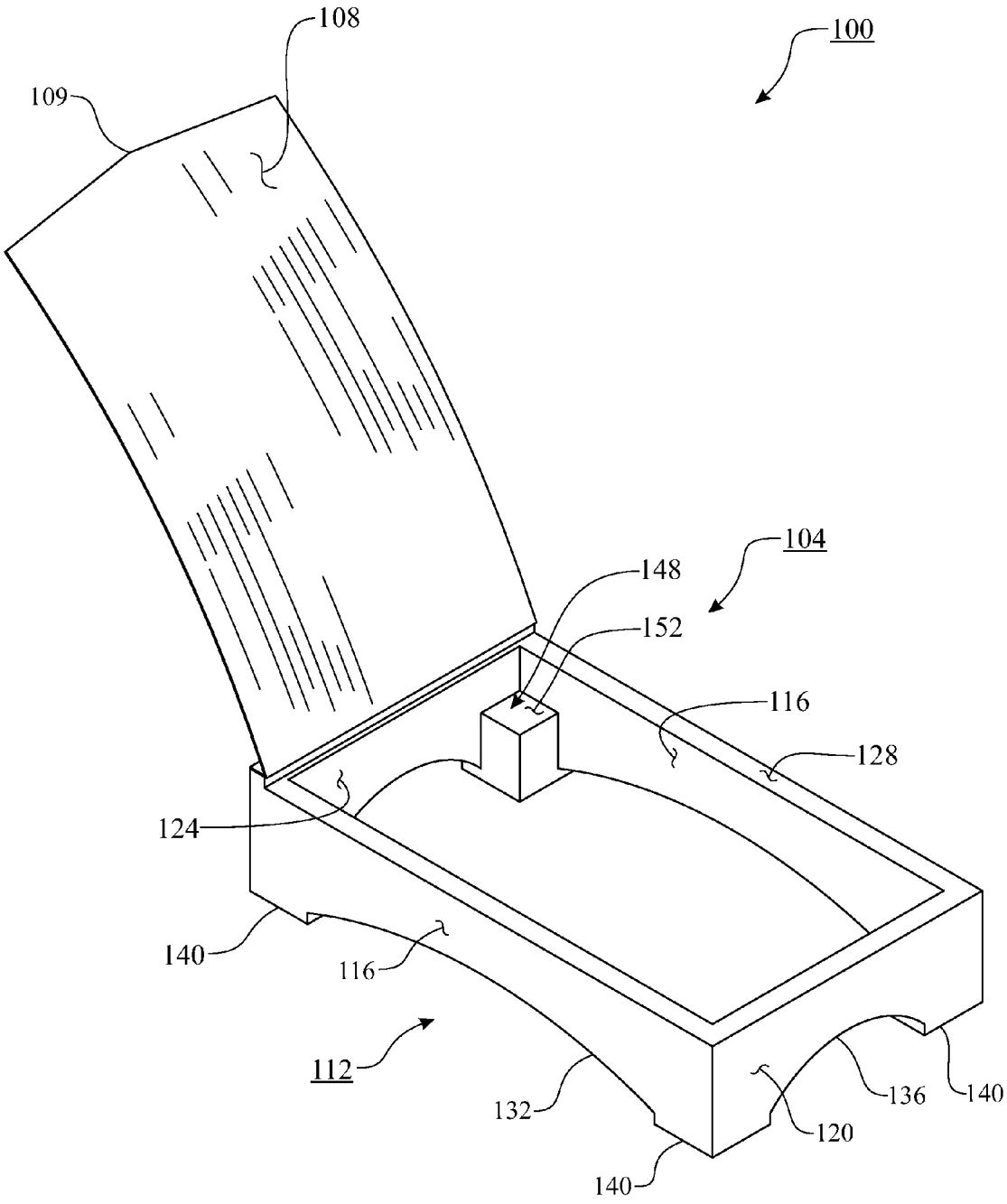
FIG. 1 presents an isometric view of a base assembly of an exemplary food slicing apparatus that is in accord with the principles of the present invention.

An exemplary food slicer 100 that is in accord with the principles of the present invention is presented in FIGS. 1 through 9. Referring now to FIG. 1, the exemplary food slicer 100 includes a base assembly 104. The base assembly 104 has a protective cover 108 and a unitary base 112. The base 112 is beneficially an integrally formed, generally rectangular structure defining a peripheral wall having a pair of opposite side walls 116, a front wall 120, and a rear wall 124 (also see FIGS. 5 and 9) and surrounding an interior central void. The protective cover 108 attaches to the top of the rear wall 124, preferably using a living hinge, but alternatively by using a slot that is located along the top of the rear wall 124 or by some other attachment mechanism. The protective cover 108 spans over a top rim 128 that is defined by the top surfaces of the opposite side walls 116, the front wall 120 and the rear wall 124. The protective cover 108 comprises a distal edge that forms a point 109 at the center of the edge, allowing easier insertion of a slicing knife 184 during cutting. The protective cover 108 is beneficially comprised of a dishwasher safe, slicing-resistant, semi-rigid plastic having friction-enhancing (such as roughened) top and bottom surfaces.

Still referring to FIG. 1, the exemplary opposite side walls 116 are configured with bottom surfaces defining long arches 132 while the exemplary front wall 120 and the exemplary rear wall 124 are configured with bottom surfaces defining short arches 136 (only one long arch 132 and one short arch 136 is illustrated in FIG. 1, but it is understood that that the base 112 is configured with a pair of arches long arches 132 and a pair of short arches 136, each on opposite ends of the base 112). The long and short arches 132, 136 of the side, front and rear walls 116, 120, 124 together with posts 148 attached at corners of the base 112 form a plurality of feet 140 at the corners where the opposite side walls 116 meet the front wall 120 and the rear wall 124 (only three feet 140 are illustrated in FIG. 1, but it is understood that that base 112 includes four feet 140, one feet 140 located at each corner). A rubber grip 144 is attached to a bottom surface of each foot 140, for preventing sliding of the food slicer 100 during cutting (see FIG. 9). It is readily apparent from the drawings that the base 112 is solely supported by the feet 140 and thus by the corners with the attached posts 148. Inside the base 112 within the interior central void and at each corner the four (4) square posts 148 are provided, each attached at one of the corners and having an upper surface 152 (only one post is shown in FIG. 1, but also see FIGS. 5 and 9) facing upwardly through a top opening of the interior central void of the base 112. Although the illustration presents arches 132, 136, it is understood that the base can include any suitable shape to ensure adequate support on a generally planar surface.

Figure 2:
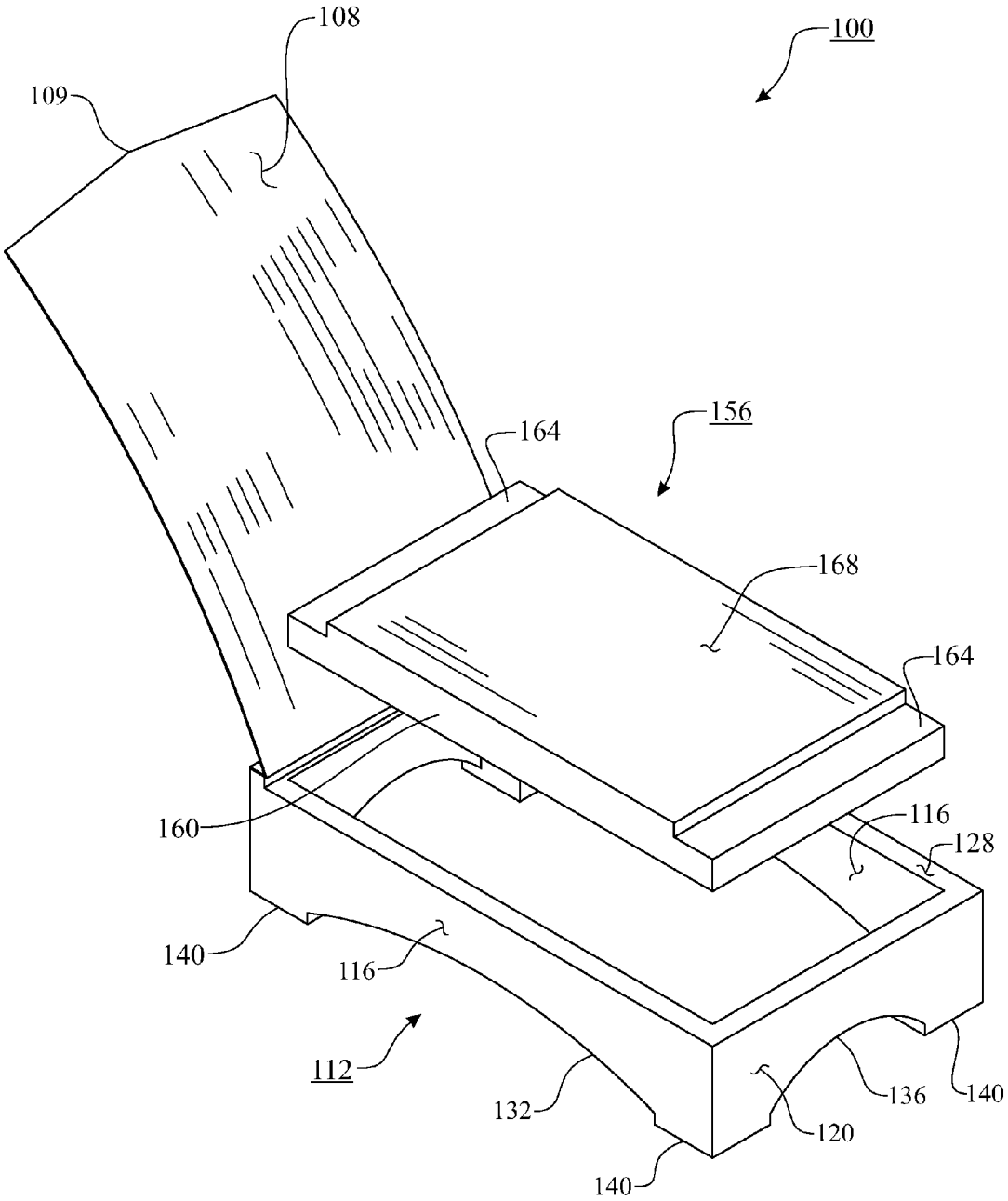
FIG. 2 presents an isometric view of the exemplary food slicing apparatus introduced in FIG. 1, wherein the illustration introduces a configuration for slicing a food product to a first thickness.
Figure 6:
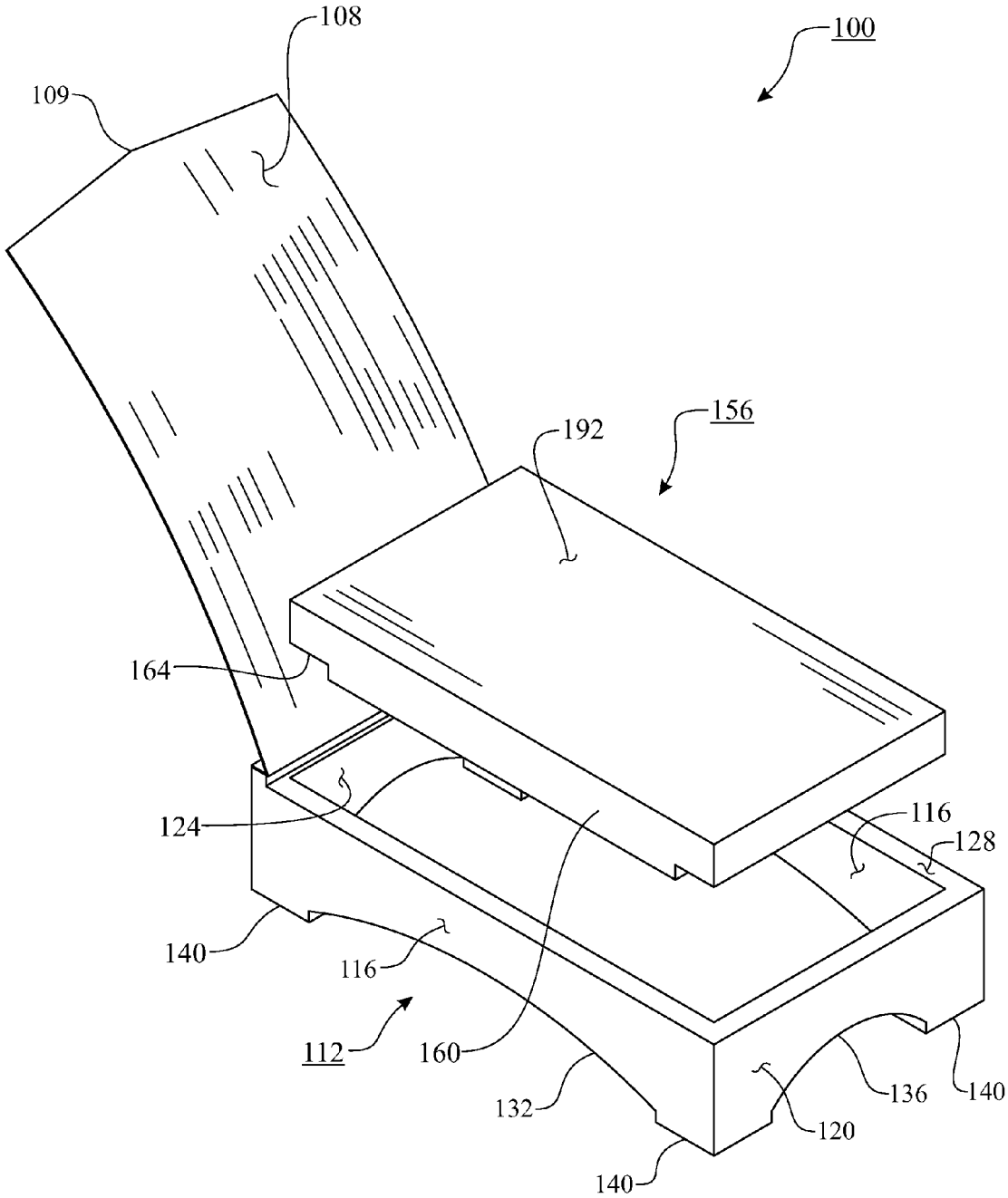
FIG. 6 presents an isometric view of the exemplary food slicing apparatus being configured to slice food products at a second thickness.

The complete food slicer 100, which not only includes the base assembly 104 but also a cutting plate 156, is illustrated in FIG. 2. The cutting plate 156 comprises friction-enhancing (such as roughened) top and bottom surfaces. The cutting plate 156 is made from a generally rectangular plate body 160. The cutting plate 156 includes rabbets or "L" shaped steps 164 formed along each supporting edge of the plated body, wherein the each supporting edge of the exemplary cutting plate 156 extend along the shorter edge thereof. The top surface of the cutting plate 156, introduced in FIG. 2, forms a surface that is referred to hereinafter as the first cutting surface 168. The design features of the cutting plate 156 locate the first cutting surface 168 at a depth from the rim 128 to support a blade 188 of the slicing knife 184 (FIG. 4) at a height to cut thin cutlets from a food product. Although the exemplary embodiment presented herein includes rabbets or "L" shaped steps 164, it is understood that any formation or supporting surface configuration can be employed to provide the desired function. The cutting plate 156 includes a first support surface at a first distance from a first cutting surface 168 and a second support surface at a second distance from a second cutting surface 192 (FIG. 6). The first distance differs from the second distance. It is understood that one of the first support surface and the second support surface can be planar with the respective cutting surface 168, 192, whereas the opposite support surface can be either proud or recessed respective to the opposite, respective cutting surface 192, 168. This enables support of the food product at two different heights respective to the rim 128. The difference in height results in different cutlet thicknesses.

Figure 3:
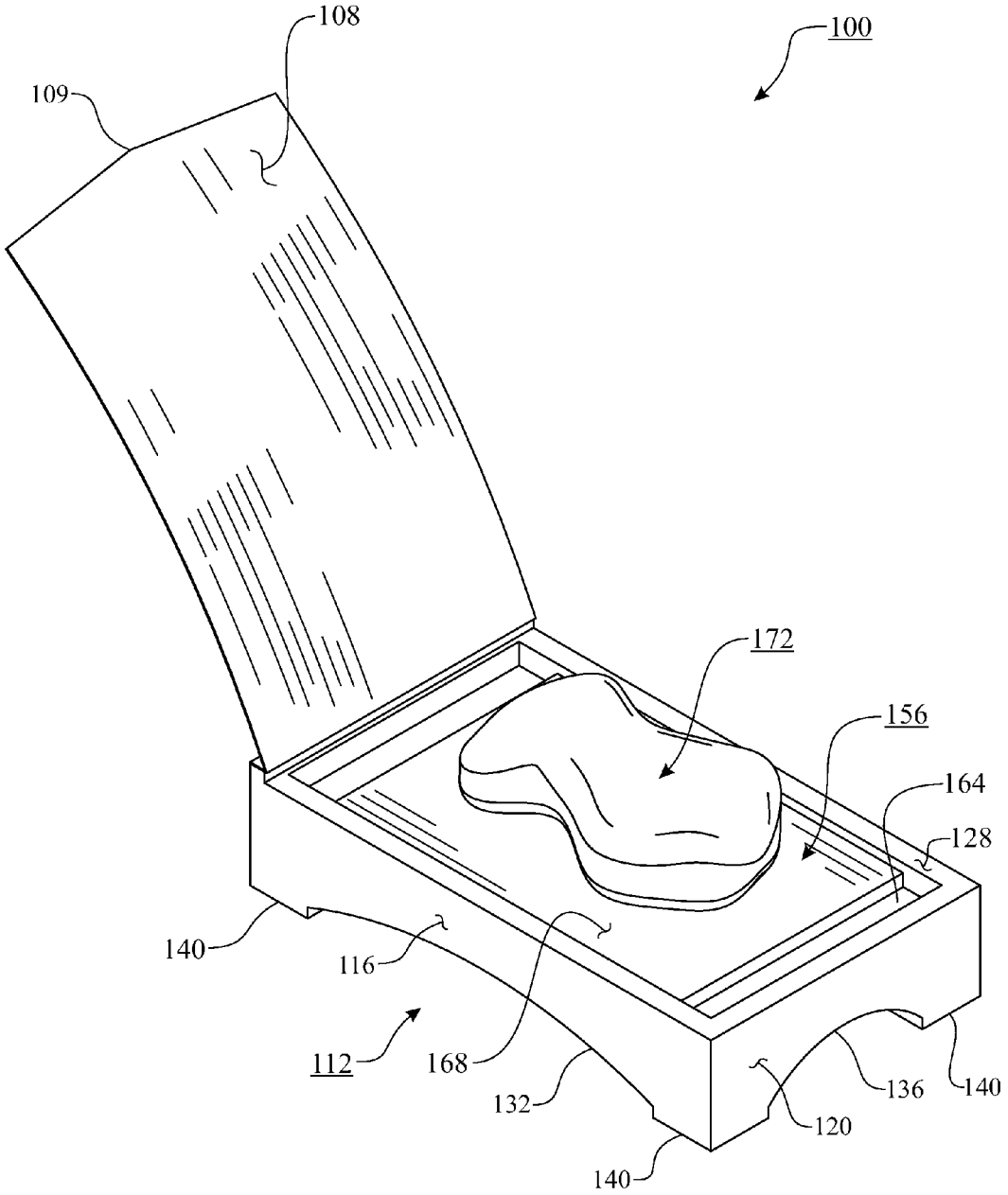
FIG. 3 presents an isometric view of the fully configured exemplary food slicing apparatus as configured in FIG. 2 retaining an exemplary food product for slicing at a first thickness.
Figure 4:
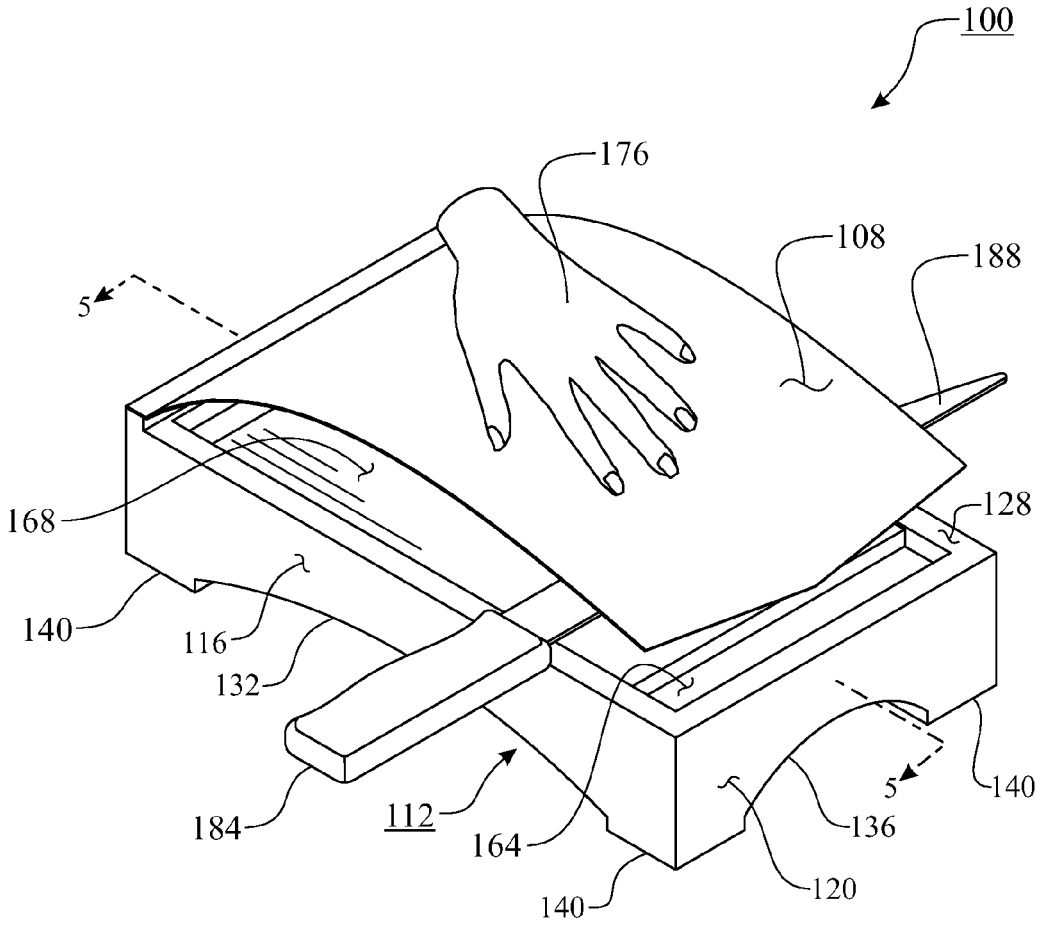
FIG. 4 presents an isometric view of the exemplary food slicing apparatus and food product configured as shown in FIG. 3 during a slicing step.

The cutting plate 156 is placed on the upper surfaces 152 of the square posts 148 (not shown in FIG. 3) such that the first cutting surface 168 is uppermost, as shown in FIG. 3. Also shown is a cutlet 172 that has been placed on the first cutting surface 168. FIG. 4 shows the configuration of FIG. 3 after the protective cover 108 is positioned over the cutlet 172 (which is not shown in FIG. 4 as it is covered). A user places a hand 176 on the protective cover 108 and presses downward slightly with a downward force 180 (see FIGS. 5 and 9) while the slicing knife 184 is placed below the protective cover 108 and across the rim 128 such that the blade 188 of the slicing knife 184 is directed toward the cutlet 172. This configuration enables safely slicing the cutlet 172 into thinner sections (see below).

Figure 5:
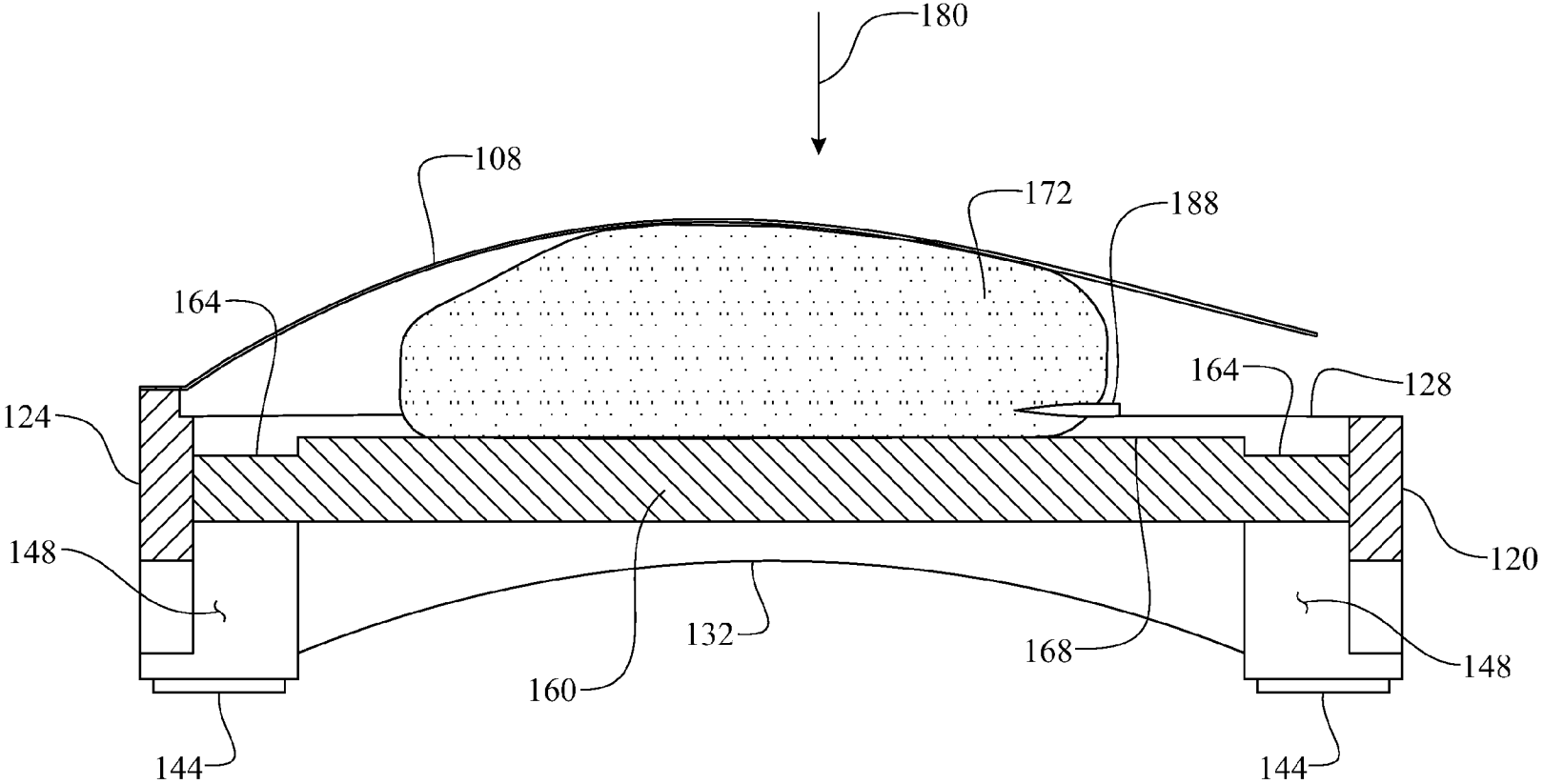
FIG. 5 presents a sectioned isometric view of the food slicing apparatus during step of slicing the food product to the first thickness, wherein the section is taken along section line 5-5 of FIG. 4.

The blade 188 is being cut into the cutlet 172, as shown in FIG. 5. The downward pressure 180 applied by the user hand 176 combined with the friction-enhancing surfaces of the protective cover 108 and the friction-enhancing surface of the first cutting surface 168 retain the cutlet 172 in position, without the hand 176 slipping. The blade 188 slides over the rim 128 during cutting. The spacing between the rim 128 and the first cutting surface 168 defines the thickness of the resulting cutlet slice.

The food slicer 100 is also configurable to cut thicker slices. FIG. 6 shows the food slicer 100 configured with the cutting plate 156 flipped over such that the rabbets or "L" shaped steps 164 are oriented facing downward. This configuration orients a second cutting surface 192 (or the side opposite the first cutting surface 168) facing upwards to support a food product during a slicing process. The second cutting surface 192 is employed when thicker slices of cutlets are desired.

Figure 7:
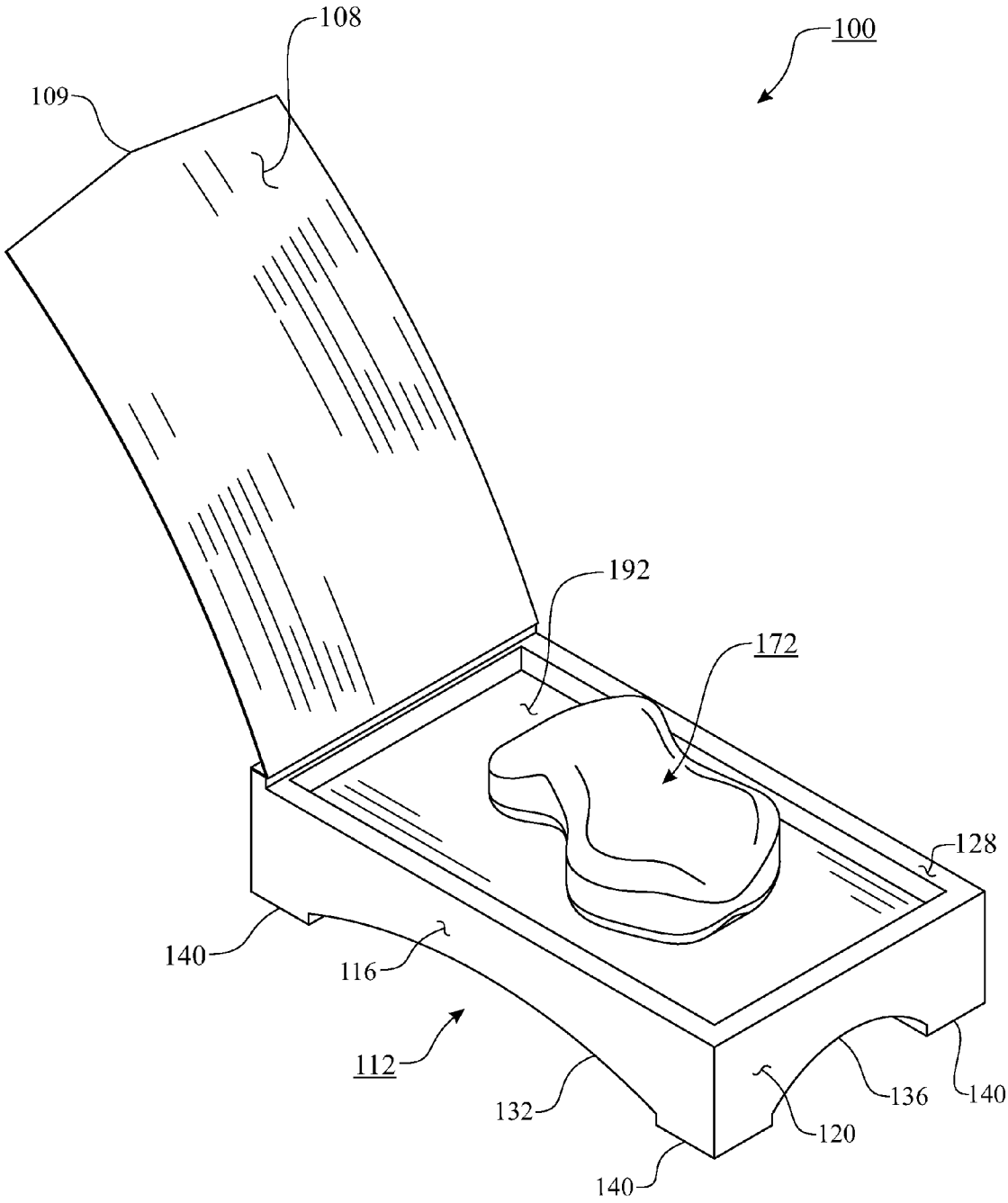
FIG. 7 presents an isometric view of the fully configured exemplary food slicing apparatus of FIG. 6 retaining a food product for slicing.
Figure 8:
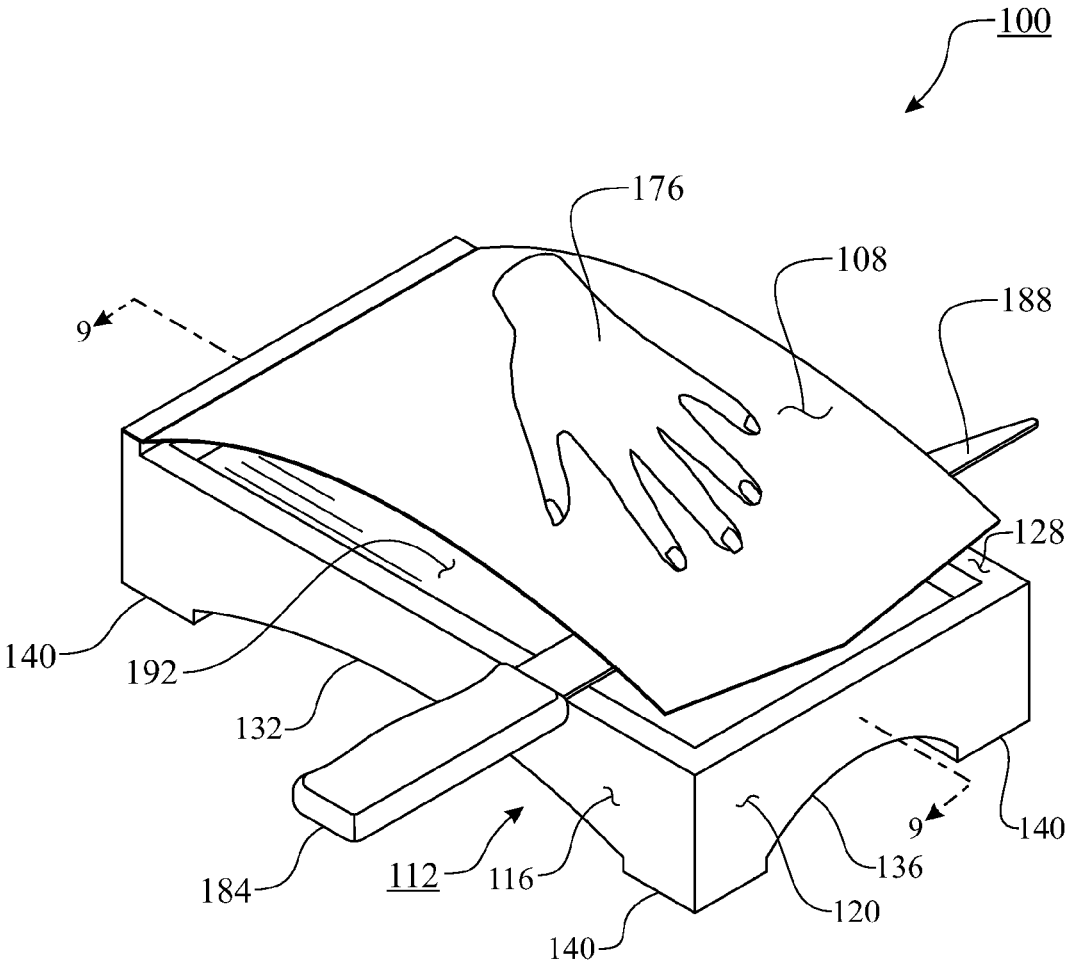
FIG. 8 presents an isometric view of the exemplary food slicing apparatus and food product shown in FIG. 7 during slicing.

The cutting plate 156 is placed on the upper surface 152 of the square posts 148 such that the second cutting surface 192 is oriented upwards, as illustrated in FIG. 7. Also shown in FIG. 7 is a cutlet 172 placed on the second cutting surface 192. FIG. 8 shows the configuration of FIG. 7 after the protective cover 108 is placed over the cutlet 172 (which is not shown in FIG. 8). The user places the hand 176 on the protective cover 108 and presses downward slightly with a downward force 180 (see FIG. 5 and FIG. 9). A slicing knife 184 is placed under the protective cover 108 and across the rim 128 such that the blade 188 of the slicing knife 184 is directed toward the cutlet 172. This configuration guides the slicing knife 194 for slicing the cutlet 172 into thicker sections.

Figure 9:
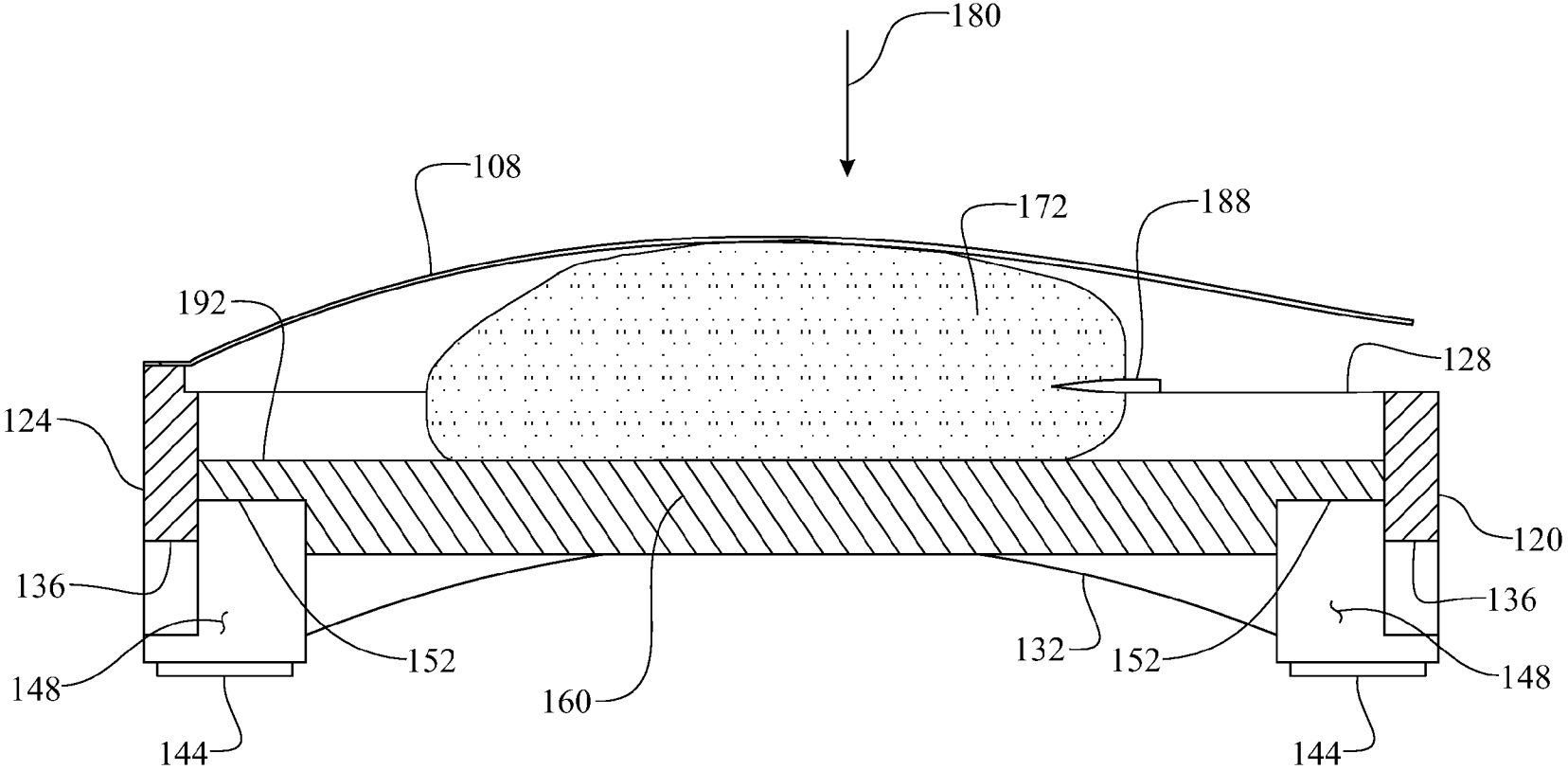
FIG. 9 presents a sectioned isometric view of the food slicing apparatus during step of slicing the food product to the second thickness, wherein the section is taken along section line 9-9 of FIG. 8.

The blade 188 is being cut into the cutlet 172, as illustrated by FIG. 9. The downward pressure 180 applied by the hand 176 combined with the friction-enhancing surfaces of the protective cover 108 and the friction-enhancing surface of the second cutting surface 192 retain the cutlet 172 in position without the hand 176 slipping. The blade 188 of the slicing knife 184 rides over the rim 128 during slicing. The spacing between the rim 128 and the second cutting surface 192 defines the thickness of the resulting sliced cutlet. The thickness of that sliced cutlet is greater than the thickness of the sliced cutlet resulting from the configuration shown in FIGS. 2-4.

Figure 10:
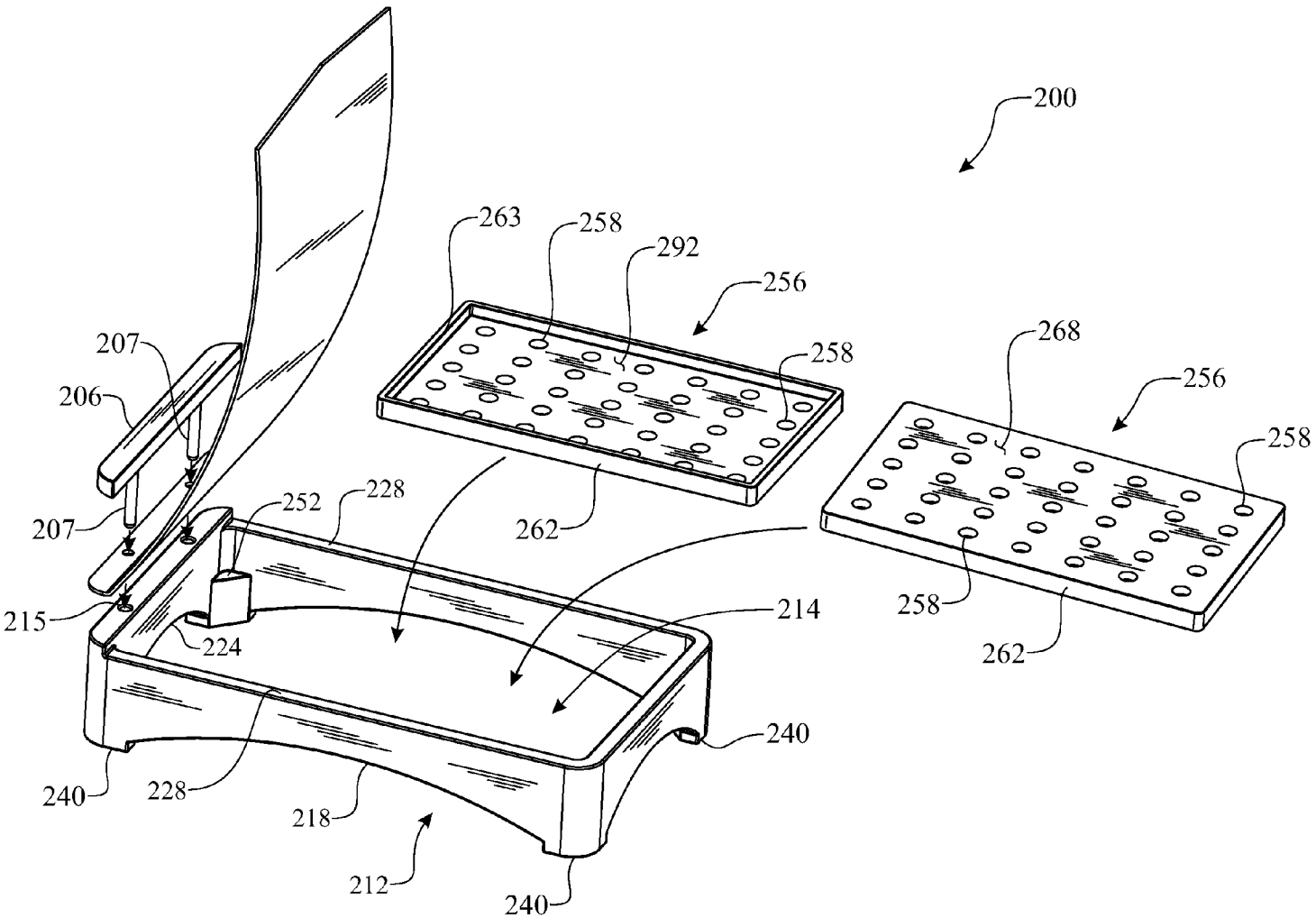
FIG. 10 presents an isometric view illustrating an alternate exemplary embodiment food slicing apparatus illustrating optional orientations of a food tray.
Figure 11:
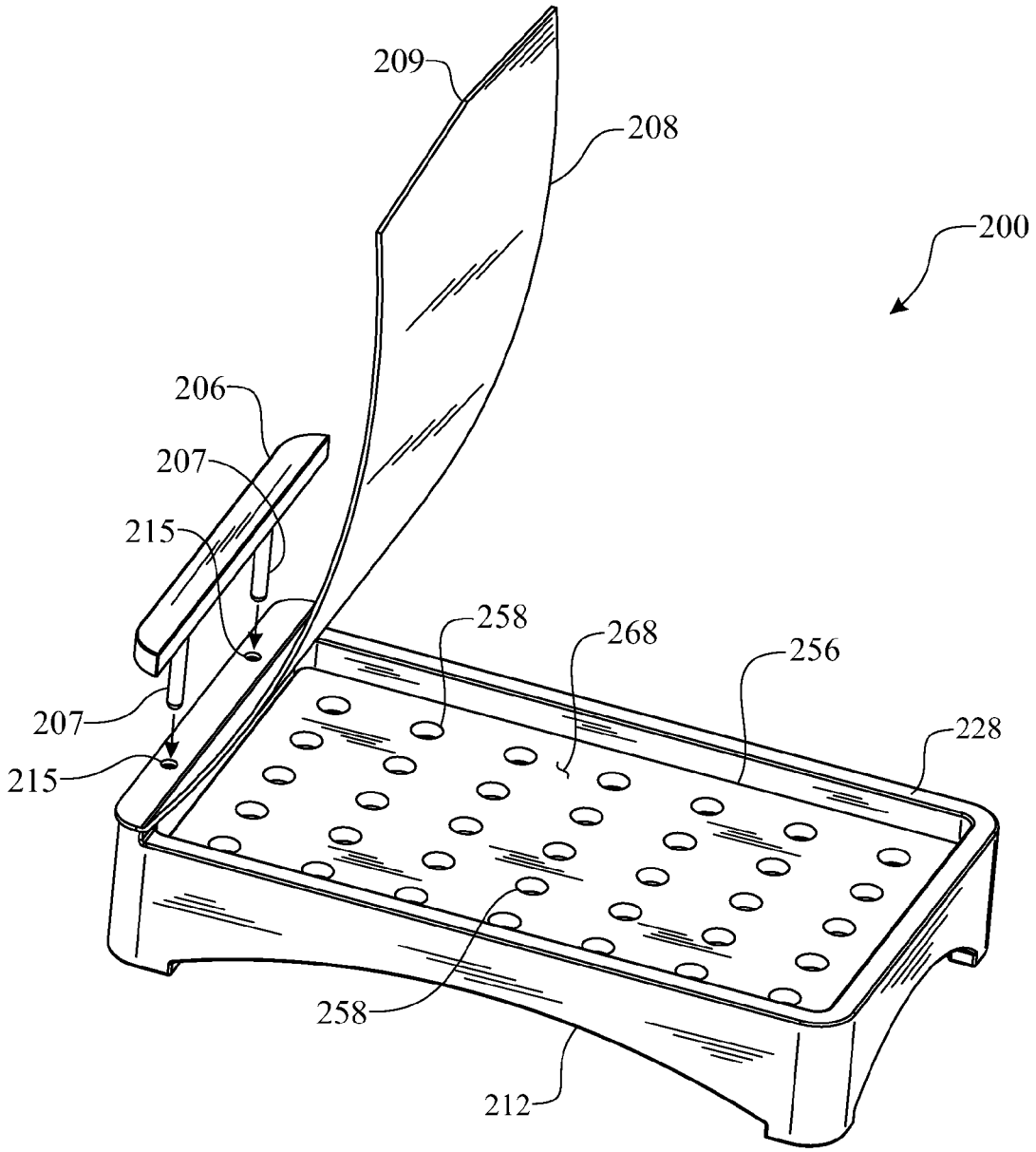
FIG. 11 presents an isometric view of the food slicing apparatus originally introduced in FIG. 10 configured for thin slicing.
Figure 12:
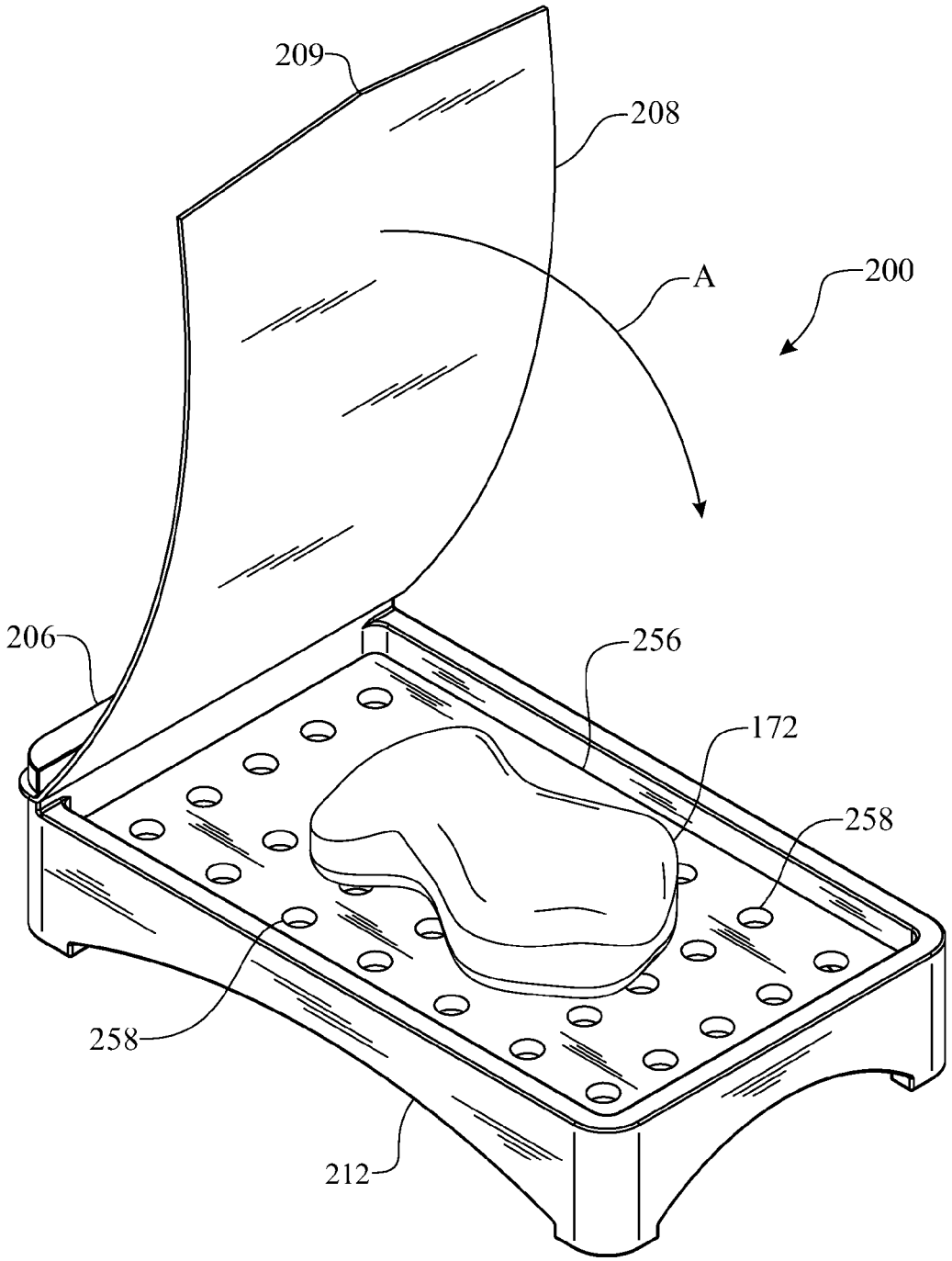
FIG. 12 presents an isometric view of the food slicing apparatus originally introduced in FIG. 10 configured for thin slicing with an article of food placed therein.

A second embodiment food slicer 200 is illustrated in FIGS. 10-11 wherein the food slicer 200 includes a unitary base 212 formed of a peripheral wall 218 in the shape of a rectangle and includes a plurality of feet 240 for support on a horizontal surface. While the base 212 is shown as being rectangular, those practiced in the art will readily recognize that other geometric shapes can be utilized while adhering to the inventive concepts disclosed herein. The unitary peripheral wall 218 has a top rim 228 and defines a central void 214 having an open top. A plurality of co-planar support surfaces 252 extend from the peripheral wall 218 into the central void 214 and are most preferably integrally formed with the unitary base 212. The plane defined by the support surfaces 252 is positioned below the plane defined by the rim 228.

The unitary base 212 includes a rear wall 224 having a pair of holes 215 extending vertically therein. The holes 215 receive a pair of posts 207 of a selectively removable retainer 206. The posts 207 of the retainer 206 engage like spaced holes in a flexible cover 208 and the holes 215 in the rear wall 224 for the purpose of securing the flexible cover 208 to the rear wall 224 of the base 212. Those practiced in the art will recognize that the flexible cover 208 can be attached to the unitary base 212 with the retainer 206 or can remain unattached and be laid over the unitary base in a free-floating manner. Further, the food slicer 200 can also be used in a manner without the cover 208. The flexible cover 208 conforms dimensionally to the base 212 such that the outer edges of the cover 208 extend at least to the outer edge of the rim 228 of the base 212. The flexible cover 208 has, at an end distal from the retainer 206, an edge formed as an obtuse angle forming a point 209 that extends beyond the outer periphery of the base 212. The cover 208 can also have an optional friction-enhancing surface to aid in the positional retention of a food article to be sliced.

A cutting plate 256 is dimensionally formed to fit within the central void 214 formed by the base 212 and to engage the support surfaces 252 to support the cutting plate proximate to the rim 228 of the base 212. The cutting plate 256 is preferably unitarily formed and includes a central planar body 260 having opposite sides, a first side defining a first cutting surface 268 and a second side defining a second cutting surface 292. The planar body 260 further defines a plurality of holes 258 therethrough to aid in retaining the article of food being sliced by permitting the lower surface of the food article to partially protrude therein and thus creating a frictional aspect to the food article for positional retention upon the cutting plate 256. The first cutting surface 268 and the second cutting surface 292 can also be formed with a friction enhanced surface to also aid in preventing the movement of the food article during the slicing process. The cutting plate 256 also includes a peripheral lip 262 extending upwardly from the periphery of the second cutting surface 292. The uppermost edge 263 of the peripheral lip 262 functions as a first bearing surface for supporting the cutting plate 256 in its thin slicing configuration. However, the peripheral lip 262 does not extend beyond the plane of the first cutting surface 268. The first cutting surface functions as a second bearing surface for supporting the cutting plate 256 in its thick slicing configuration. The cutting plate 256 is selectively removable from the base 212 and can be inverted to use either the first cutting surface 268 or the second cutting surface 292 depending on the desired finished thickness of food being sliced by the user.

In use, and as illustrated in FIGS. 12-15, the food slicer 200 can be utilized to slice a meat cutlet 172. If the meat cutlet is desired to be sliced into thin cutlets, the cutting plate 256 is placed in the central void 214 such that the first cutting surface 268 is presented facing upwardly from the void 214 and the peripheral lip 262 extends downwardly to engage and rest on the support surfaces 252. In this configuration, the first cutting surface 268 is positioned most proximate to the rim 228 of the base 212. The cover 208 is lowered (as show by Arrow 'A' in FIG. 12) over the base 212 to cover the cutlet 172.

Figure 13:
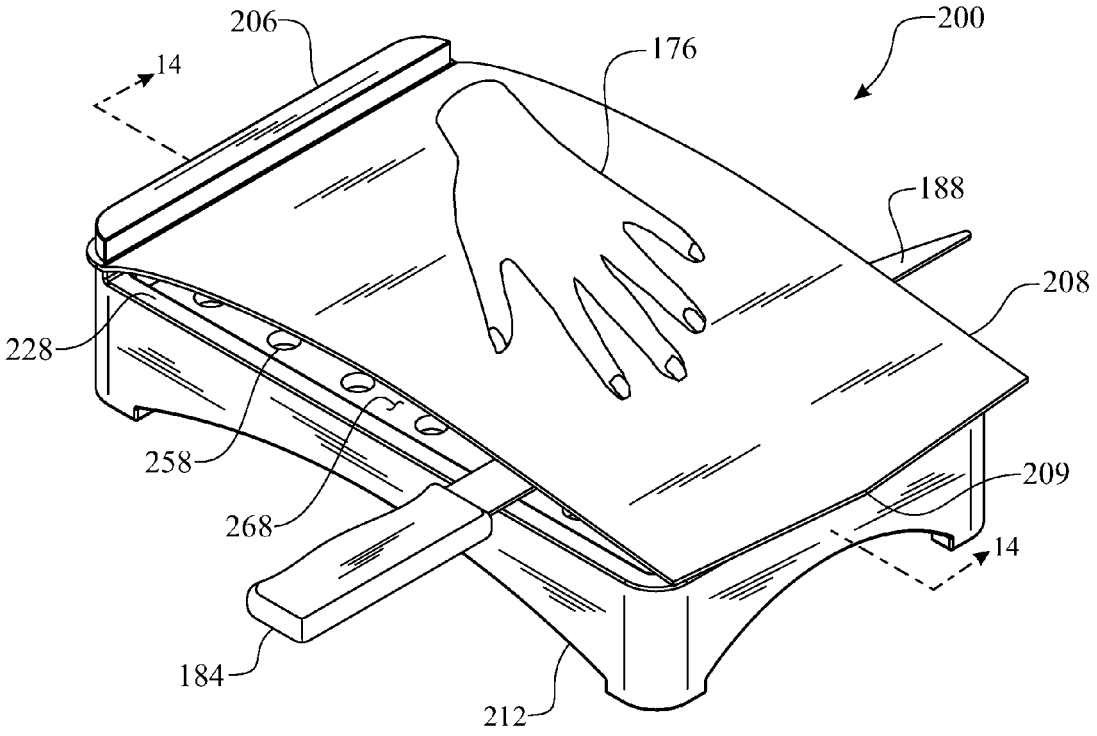
FIG. 13 presents an isometric view of the food slicing apparatus originally introduced in FIG. 12 illustrating the slicing of the food within the food slicing apparatus.
Figure 14:
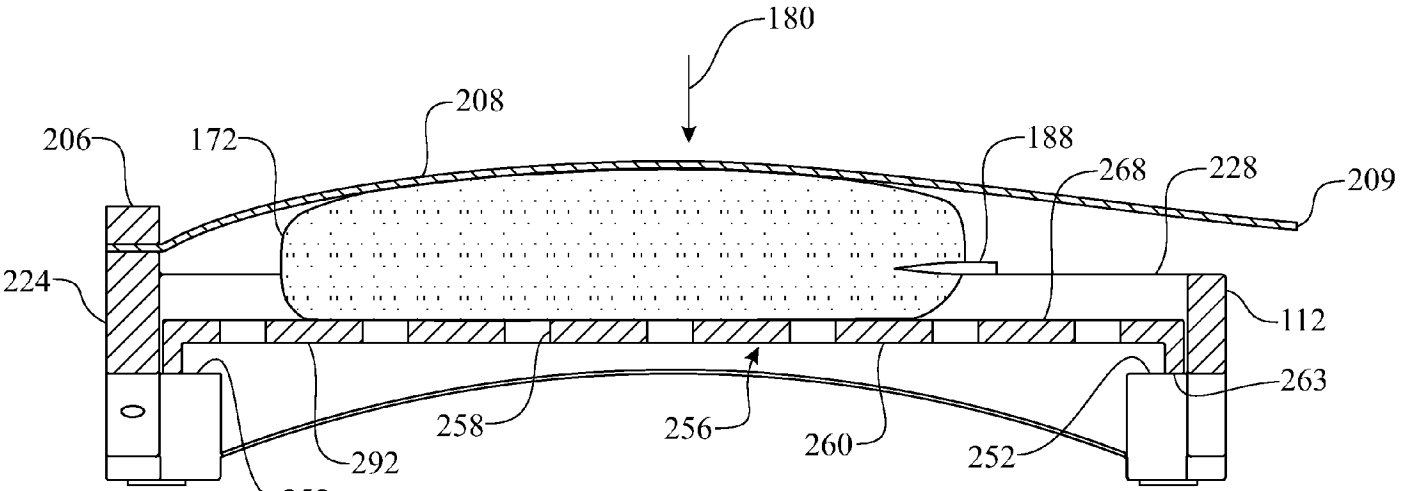
FIG. 14 presents an elevational cross-sectional view of the food slicing apparatus of FIG. 13, wherein the section is taken along section line 14-14 of FIG. 13.

As now shown in FIG. 13, the user places a hand 176 on the top of the closed cover 208 and inserts the blade 188 of a slicing knife 184 under the cover 208 and resting the cutting edge of the blade 188 on the rim 228 of the base 212. Referring to FIG. 14, the user applies a downward force 180 on the cover 208. The downward force 180 applies pressure to the meat cutlet 172 and through interaction with one or more of the holes 258 in the body 260 of the cutting plate 256 and with the friction-enhancing surface of the cover 208 and the body 260, the cutlet 172 is positionally retained on the cutting plate 256. Using the rim 228 as a guide, the user applies a slicing action to the knife blade 188 to produce a thin cutlet. The process can be repeated until the original cutlet 172 has been sliced into a plurality of thinner cutlets.

Figure 15:
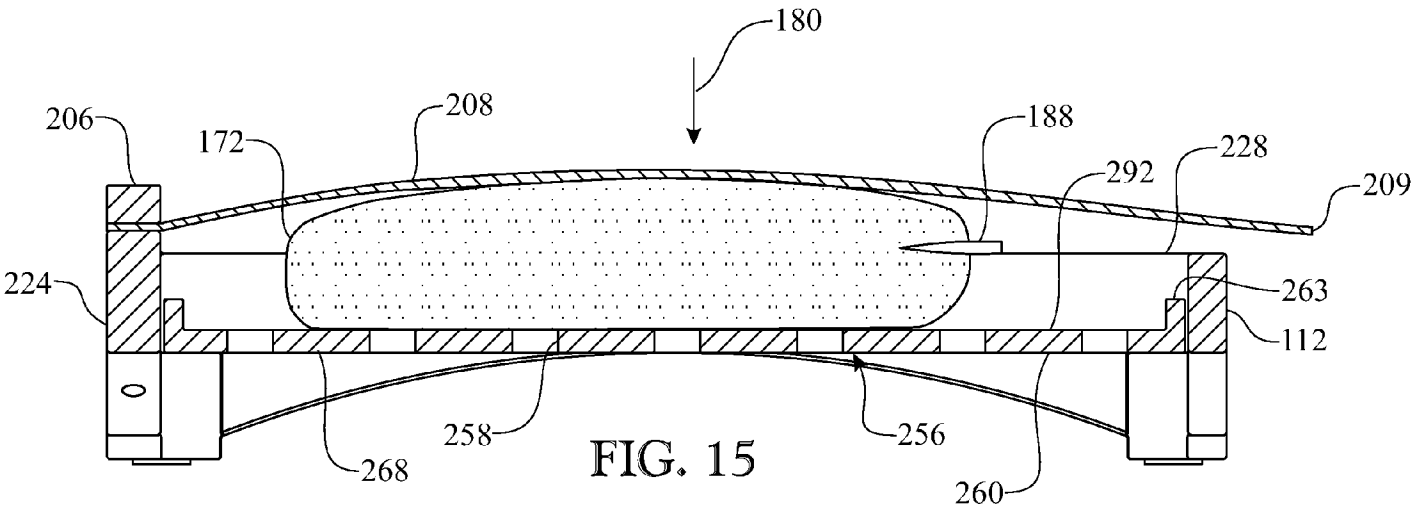
FIG. 15 presents the elevational cross-sectional view of FIG. 14, wherein the food tray is in an inverted thick slicing configuration.

As shown in FIG. 15, and to produce a thicker cutlet slice, the cutting plate 256 is inverted within the base 212 such that the second cutting surface 292 is now presented facing upwardly from the void 214 and the peripheral lip 262 extends upwardly also. The first cutting surface 268 faces downwardly and engages the support surfaces 252 to support the cutting plate 256 in the base 212. In like manner to cutting a thin cutlet, the original unsliced cutlet 172 is placed on the second cutting surface 292, the cover 208 is closed, and the user's hand 176 applies vertical force 180 to the top of the cover 208. The knife blade 188 uses the rim 228 of the base as a guide and with a slicing action along the plane of the rim 228, the blade slices through the original cutlet 172 producing thinner cutlets. The sliced cutlets so produced are thicker than the cutlets produced utilizing the previous inverted orientation of the cutting plate 256 since, by reason of the configuration of the peripheral lip 263, the second cutting surface 292 is more distal from the rim 228 than the first cutting surface 268 when the first cutting surface 268 is oriented to face upwardly from the central void 214.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

We claim:

1. A food slicer, said food slicer comprising:

a base having a peripheral wall surrounding an interior central void in said base, said peripheral wall having a plurality of corners spaced from one another, a top rim interconnecting said corners and defining a top opening to said interior central void and a top planar surface encompassing said top opening, a plurality of bottom surfaces spaced apart from one another and from said top planar surface, said bottom surfaces extending between said corners and recessed upwardly toward said top planar surface, and a plurality of posts disposed in said interior central void of said base, each of said posts having an upper support surface spaced below said top rim of said peripheral wall and a bottom surface spaced below and substantially aligned with said upper support surface, said each post being attached to one of said corners such that said bottom surface faces downwardly away from said top opening of said base and said upper support surface faces upwardly through said top opening of said base, said upper support surfaces being substantially co-planar with one another;

wherein said plurality of corners of said peripheral wall with said recessed bottom surfaces on said peripheral wall and said bottom surfaces of said respectively attached posts together form a plurality of feet at said corners and within said interior central void that extend between and downward beyond said recessed bottom surfaces of said peripheral wall so as to support said base on a support surface solely by said feet; and a cutting plate having a body and opposite first and second cutting surfaces on opposite first and second sides of said body, said cutting plate being selectively invertible and dimensioned to fit through said top opening of said interior central void of said base to within said interior central void and placed upon said upper support surfaces of said posts to present one or the other of said first and second cutting surfaces for use in corresponding one or the other of thin and thick cutting positions;

wherein said first cutting surface when said cutting plate is at said thin cutting position is closer to said top surface of said top rim than is said second cutting surface when said cutting plate is removed from said upper support surfaces of said posts through said top opening of said interior central void of said base, inverted from said thin cutting position and fitted back through said top opening of said interior central void of said base and placed upon said upper support surfaces of said posts at said thick cutting position.

2. The food slicer according to claim 1 wherein said peripheral wall of said base is rectangular in shape.

3. The food slicer according to claim 1 further comprising a cover having a pair of opposite edge portions, said cover being affixed at one of said opposite edge portions to an end portion of said peripheral wall of said base and dimensioned to span over said top rim of said endless peripheral wall such that said cover is movable relative to said cutting plate between an open position and a closed position in which said cover spans over said interior central void of said base and said cutting plate.

4. The food slicer according to claim 3 wherein said cover is formed of a flexible material.

5. The food slicer according to claim 3 wherein said cover at the other edge portion opposite from said one edge portion being affixed to said peripheral wall of said base is formed as an obtuse angle so as to define a point on said other edge portion proximate a center thereof.

6. The food slicer according to claim 3 wherein said cover also has opposite surfaces wherein at least one of said opposite surfaces is a friction-enhanced surface.

7. The food slicer according to claim 1 wherein said body of said cutting plate has a plurality of holes formed therethrough.

8. The food slicer according to claim 1 wherein said first cutting surface and said second cutting surface of said cutting plate are configured as a friction enhanced surface.

9. The food slicer according to claim 1 wherein said cutting plate includes a peripheral lip extending upwardly from said second cutting surface so as to function as a bearing surface for engaging said upper support surfaces of said posts when said cutting plate is oriented to present one of said first and second cutting surfaces for use.

10. The food slicer according to claim 1 wherein said cutting plate includes a plurality of rabbets in said first cutting surface at opposite end portions of said body, said rabbets defining bearing surfaces for engaging said upper support surfaces of said posts when said cutting plate is oriented to present one of said first and second cutting surfaces for use.

11. The food slicer according to claim 1 wherein said recessed bottom surfaces extending between said corners of said base have arched configurations.

12. A food slicer, comprising:

a base having a pair of opposite side walls, a front wall disposed between and interconnecting front ends of said opposite side walls so as to form a pair of front corners of said base being spaced apart from each other, a rear wall disposed between and interconnecting rear ends of said opposite side walls so as to form a pair of rear corners of said base being spaced apart from each other and from said front corners, said opposite side walls and said front and rear walls of said base together defining an interior central void in said base, a top rim formed by top portions of said opposite side walls and said front and rear wall portions, said top rim defining a top opening to said interior central void in said base and a top surface on said base encompassing said top opening, and a plurality of bottom surfaces on said opposite side walls and front and rear walls of said base extending between said front corners, said rear corners, and said front and rear corners, said bottom surfaces having arched configurations, spaced apart from one another and from said top surface and being recessed upwardly toward said top surface;

a plurality of posts disposed in said interior central void of said base, each of said posts having an upper support surface spaced below said top rim and a bottom surface spaced below and substantially aligned with said upper support surface, said each post being attached to one of said corners such that said bottom surface faces downwardly away from said top opening of said base and said upper support surface faces upwardly through said top opening of said interior central void of said base, said upper support surfaces being substantially co-planar with one another;

wherein said front and rear corners of said base with said bottom surfaces on said side, front and rear walls and said bottom surfaces of said respectively attached posts together form a plurality of feet at said corners and within said interior central void that extend between and downward beyond said recessed bottom surfaces of said base so as to support said base on a support surface solely by said feet;

a cutting plate dimensioned to fit within said interior central void of said base so as to rest on said upper support surfaces of said posts, said cutting plate selectively invertible between a first orientation for presenting a first cutting surface for use and a second orientation for presenting a second cutting surface for use; and a protective cover at one edge portion being pivotally attached to said rear wall of said base and dimensioned to span across said top rim of said base such that said cover is pivotally movable relative to said cutting plate between an open position and a closed position in which said cover spans over said interior central void of said base and said cutting plate.

13. The food slicer according to claim 12 wherein said cutting plate has a plate body with rabbets on one side thereof and wherein said second cutting surface is opposed from said rabbets and said first cutting surface is adjacent said rabbets, said rabbets located and dimensioned to rest on said upper support surfaces of said posts so as to form a first distance between said second cutting surface and said upper surface of said top rim and wherein when said second cutting surface rests on said upper support surfaces of said posts a second distance is formed between said first cutting surface and said upper surface of said top rim, and wherein said second distance is less than said first distance.

14. The food slicer according to claim 12 wherein said second cutting surface and said first cutting surface are formed as a friction enhancing surface.

15. The food slicer according to claim 12 wherein said cutting plate has a plate body defining said first cutting surface on a first side thereof and said second cutting surface on a second side thereof and further including a lip extending upwardly from a periphery of said second cutting surface, wherein when said first cutting surface rests on said upper support surfaces of said posts a first distance is formed between said second cutting surface and said upper surface of said top rim and when said cutting plate is inverted an upper edge of said lip rests on said upper support surfaces of said posts to form a second distance between said first cutting surface and said upper surface of said top rim wherein said second distance is less than said first distance.

16. The food slicer according to claim 15 wherein said plate body has a plurality of holes formed therethrough.

17. The food slicer according to claim 12 wherein said protective cover is formed of a flexible material.

18. The food slicer according to claim 12 wherein at least one surface of said protective cover has a friction-enhanced surface.

19. The food slicer according to claim 12 wherein said protective cover at said other edge portion opposite from said one edge portion affixed to said rear wall of said base is formed as an obtuse angle so as to define a point on said other edge portion proximate a center thereof.

* * * * *